US010052666B1

(12) United States Patent
Cochran et al.

(10) Patent No.: US 10,052,666 B1
(45) Date of Patent: Aug. 21, 2018

(54) IN SITU FOAM GENERATION APPARATUS FOR ON-SITE, ON-DEMAND, ECONOMICAL PRODUCTION OF FOAMING SOLVENTS

(71) Applicant: Easy Foam, Inc., Stillwater, OK (US)

(72) Inventors: Donald Cochran, Stillwater, OK (US); Greg Larson, Stillwater, OK (US)

(73) Assignee: Easy Foam, Inc., Basalt, CO (US)

( * ) Notice: Subject to any disclaimer, the term of this patent is extended or adjusted under 35 U.S.C. 154(b) by 0 days.

(21) Appl. No.: 14/936,100

(22) Filed: Nov. 9, 2015

Related U.S. Application Data

(60) Provisional application No. 62/076,774, filed on Nov. 7, 2014.

(51) Int. Cl.

| | |
|---|---|
| ***B08B 3/04*** | (2006.01) |
| ***B05B 1/02*** | (2006.01) |
| ***B05B 7/00*** | (2006.01) |
| ***B05B 11/00*** | (2006.01) |
| ***B08B 3/00*** | (2006.01) |
| ***B05B 15/20*** | (2018.01) |

(52) U.S. Cl.
CPC ..... *B08B 3/04* (2013.01); *B05B 1/02* (2013.01); *B05B 7/0025* (2013.01); *B05B 11/3047* (2013.01); *B05B 15/20* (2018.02); *B08B 3/003* (2013.01)

(58) Field of Classification Search
CPC combination set(s) only.
See application file for complete search history.

(56) References Cited

U.S. PATENT DOCUMENTS 2,680,010 A * 6/1954 Dubay ..... B05B 7/0037 239/343
2,998,963 A * 9/1961 Rinderle ..... A21C 1/06 222/341
4,133,773 A * 1/1979 Simmons ..... B08B 3/003 134/22.1
5,417,233 A * 5/1995 Thomas ..... A47L 15/4436 134/113
5,460,724 A * 10/1995 Schwering ..... B01J 45/00 210/108

(Continued)

FOREIGN PATENT DOCUMENTS

CA 2148192 A1 * 10/1996 ..... B05B 7/0037

*Primary Examiner* — Jason Y Ko
*Assistant Examiner* — Cristi J Tate-Sims
(74) *Attorney, Agent, or Firm* — Gable Gotwals

(57) ABSTRACT

An in-situ foam generation apparatus includes a dissolution chamber that houses a polymer stick cavity or canister, a mixing chamber that houses a static mixer, and a foaming chamber that houses a mechanical agitator in fluid communication with a compressed air inlet. The chambers are in fluid communication with one another by way of a respective chamber inlet and outlet, with the mixing chamber being located between the dissolution and foaming chambers. A pressure regulator can be used to control the incoming aqueous solution pressure to the dissolution chamber. A nozzle exhaust is in fluid communication with the outlet of the foaming chamber. One or more polymer sticks that include one or more cleaning agent can be loaded into the cavity or canister of the dissolution chamber. An end consistency of the polymer stick can be in a range of partially solidified to fully solidified.

16 Claims, 4 Drawing Sheets

(56) References Cited

U.S. PATENT DOCUMENTS

| | | | | |
|---|---|---|---|---|
| 6,592,249 | B1 * | 7/2003 | Hausbichler | B29B 7/407<br>366/184 |
| 2004/0175323 | A1 * | 9/2004 | Franz | B01J 8/067<br>423/486 |
| 2006/0052263 | A1 * | 3/2006 | Roreger | C11D 3/222<br>510/141 |
| 2007/0228085 | A1 * | 10/2007 | Lin | A61L 2/22<br>222/635 |
| 2009/0236025 | A1 * | 9/2009 | Burkus | B01F 7/00258<br>156/60 |

* cited by examiner

IN SITU FOAM GENERATION APPARATUS FOR ON-SITE, ON-DEMAND, ECONOMICAL PRODUCTION OF FOAMING SOLVENTS

CROSS-REFERENCE TO PENDING APPLICATIONS

This application claims priority to U.S. Prov. Pat. Appl. No. 62/076,774, filed Nov. 7, 2014.

FIELD OF INVENTION

The present invention relates to an in-situ foam generation device that can be used to deposit surface activation agents onto industrial equipment. One embodiment is to remove dust, inorganic and organic residues from industrial devices such as, but not limited to, radiators and cooling towers.

BACKGROUND OF THE INVENTION

Effective removal of heat generated from machines in an industrial plant is critical to its function; heat accumulation can be detrimental to manufacturing equipment and can lower operating efficiency. Hence energy efficiency and economics of the overall plant directly depend on the rate of heat removal. Fin-and-fan heat exchangers are commonly used in industrial heating, ventilation and heat exchange systems. Waste heat transfers to the fins, and is dissipated by fans generally through forced air convection. Concomitantly these systems need periodic maintenance to facilitate effective heat removal. Similarly, heat exchange systems including compressor radiator and aerial coolers also require constant maintenance.

Heat exchangers are typically deployed in an open field setting and are constantly exposed to dust, debris, industrial exhaust, chemical residues, high temperatures and potentially corrosive environments. Accumulation of dirt, debris or chemical/organic residues on the fins over time drastically lowers the rate of heat removal. This decreases cooling efficiency of the heat exchangers and can lead to reduced production rates and increase energy costs. These factors highlight the need for periodic cleaning of heat exchangers in order to maintain and enhance their operational efficiency.

Traditional methods for cleaning heat exchange systems include low/high pressure water rinsing, soda blasting and ice blasting. Both low and high pressure water rinsing are not effective against most inorganic residues and can potentially damage the fins. On the other hand, soda and ice blasting methods require multiple cleaning steps that are not effective and are very expensive. The other approach to cleaning the fins is the use of strong caustic liquid chemicals to clean the fin surface. These chemicals can be effective against most dirt and chemical/organic residues. However, the major limitation in using aqueous chemicals and solvents is reduced contact time with the heat exchanger surface.

The current state of the art technique for effective cleaning of heat exchangers is to use foaming agents in tandem with cleaning chemicals. This foaming soap is sprayed directly on the fins. Foaming dramatically increases chemical contact time thereby improving cleaning efficiency. Though effective, foam cleaning can be limited because these liquid cleaning/foaming agents are required to be stored in a secondary containment. Also, transportation regulations and plant operational safety standards limit the amount of liquid chemicals that can be transported and stored onsite. This increases both the time consumed in cleaning the heat exchangers and overall costs. In addition to liquid chemical handling limitations, complex flow circuits involving heavy-duty water pumps and air compressors are assembled to uniformly mix the liquid chemicals with water and generate preferred foam consistency. The construction, operation and maintenance of these flow circuits add significant capital costs to the cleaning operation.

Indeed, there is a demonstrated demand for a portable device that is capable of generating foam in-situ from chemicals on-site and on-demand.

SUMMARY OF THE INVENTION

The present invention relates to an apparatus for generating soft foam on-demand to clean various surfaces in any industrial environment by utilizing completely or partially solidified polymer sticks that are saturated with cleaning agents (chemicals) and dissolving and foaming the sticks in water at different pressures. An aqueous solution, preferably water, enters the dissolution chamber, dissolves the polymer stick and releases the stored chemicals. The released chemicals are then mixed and foamed in the consecutive chambers before finally being discharged through a nozzle exhaust.

A preferred embodiment of the apparatus includes four major components being housed in a single unit: (1) a dissolution chamber wherein the polymer stick is dissolved; (2) a mixing chamber wherein the dissolved chemicals are mixed uniformly with water; (3) a foaming chamber wherein the dissolved chemicals are agitated and mixed with air to generate foam; and (4) a nozzle exhaust to spray foam uniformly on to the surface that needs to be activated.

Preferably, the polymer sticks contain a composition of foaming and cleaning agents along with the base polymer for use in the apparatus. The polymer stick design also provides the ability to introduce more than one cleaning agent to the soft foam to remove specific contaminants.

In one preferred embodiment, the polymer sticks are of varying consistency (e.g., completely solidified, partially solidified) with no effect on chemical composition or foaming ability. This provides a higher flexibility in handling, storage and usability. Moreover, the varying designs facilitate the deployment of the apparatus in different field settings that can present different ambient conditions.

One of two preferred dissolution chamber designs can be used with polymer sticks of varying consistency. Both chamber designs facilitate uniform dissolution of the polymer sticks in aqueous solutions, preferably water, and enable consistent chemical concentration in the foam generated at the outlet.

The polymer stick chemical configuration and packing can be customized for specific applications including, but not limited to, cleaning of dirt, organic residues, and chemical residues. The apparatus can be configured or scaled for deployment in various field settings.

In one preferred embodiment, the in-situ foam generation apparatus includes a dissolution chamber that houses a polymer stick cavity or canister, a mixing chamber that houses a static mixer, and a foaming chamber that houses a mechanical agitator and a compressed air inlet. The chambers are in fluid communication with one another by way of a respective chamber inlet and outlet, with the mixing chamber being located between the dissolution chamber and the foaming chamber. The dissolution chamber inlet is an aqueous solution inlet and a pressure regulator can be used to control the incoming pressure to the chamber. A nozzle exhaust is in fluid communication with the outlet of the foaming chamber.

One or more polymer sticks that include one or more cleaning agents can be loaded into the cavity or canister of the dissolution chamber. An end consistency of the polymer stick can be in a range of partially solidified to fully solidified.

The dissolution chamber can include an injection manifold connected to the dissolution chamber inlet and having an array of jet nozzles oriented toward the polymer stick canister. A plunger-cylinder assembly, in fluid communication with a compressed air source, is arranged to move the injection manifold relative to the polymer stick canister. The injection manifold can be maintained at a constant distance from the polymer stick canister or polymer stick.

In another embodiment, the dissolution chamber can include a plunger-cylinder assembly arranged to apply a shear stress to a contents of the polymer stick canister. An extruder nozzle can be connected to a bottom of the polymer stick canister with its outlet oriented downstream (toward the mixing chamber).

The static mixer of the mixing chamber can be a porous packing material such as a metal mesh or a non-reactive gravel mixture. Or, the static mixer can be an array of fixed baffles.

The mechanical agitator of the foaming chamber can be controlled by an inlet pressure of the foaming chemical and the compressed air entering the foaming chamber. The pressure of the compressed air entering the foaming chamber also can be controlled to maintain the quality of foam produced at the foaming chamber outlet.

A preferred embodiment of a system for delivering a cleaning agent on-demand as soft foam includes a housing having a water inlet side and a nozzle outlet side; a water-dissolvable polymer stick located toward the water inlet side of the housing and containing at least one cleaning agent; a mixing chamber located adjacent to the dissolution chamber and arranged to receive the at least one cleaning agent when released from the polymer stick and statically mix the released cleaning agent in water uniformly; and a foaming chamber located toward the nozzle outlet side of the housing and arranged to receive a compressed air input and agitate the cleaning agent and water mixture from the mixing chamber to generate foam at the nozzle outlet.

Objectives of this invention are to provide an apparatus, system and method that (1) provides in-situ foam generation at the point of use and can do so on demand and (2) can accommodate a variety of different polymer sticks and their respective cleaning agents.

ELEMENTS AND NUMBERING USED IN THE DRAWINGS AND DETAILED DESCRIPTION

Figure 1:
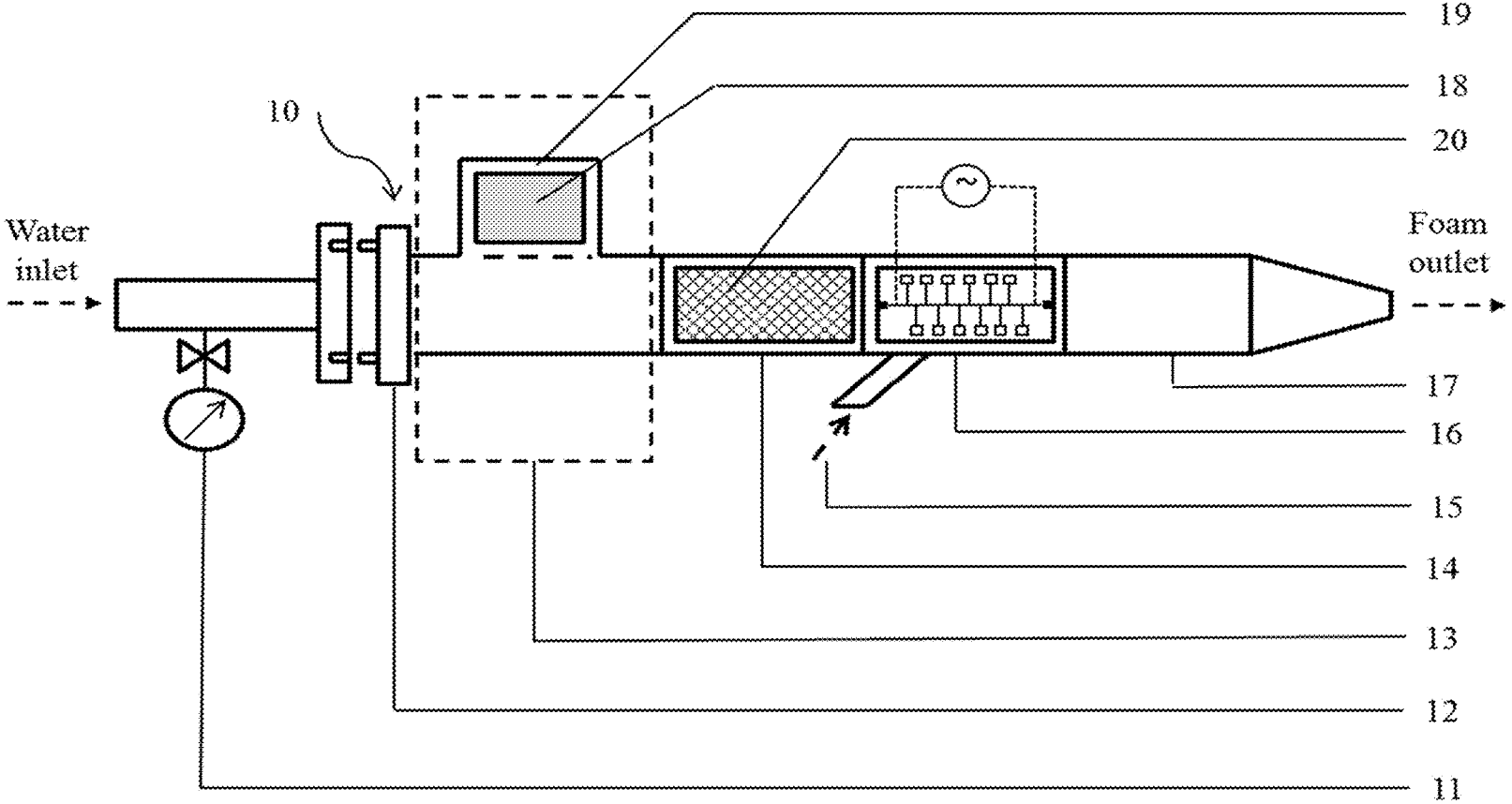
FIG. 1 is a sketch showing an embodiment of the in situ foam generation apparatus. The apparatus is portable and in the form of a longitudinally extending wand including the dissolution, static mixing and foam generation chambers located between the water inlet end and nozzle exhaust end of the wand.

10 In situ foam generation apparatus or wand
11 In-line water pressure regulator (also indicating the aqueous solution or water line)
12 Flange connector
13 Dissolution chamber
14 Mixing chamber
15 Compressed air line
16 Foaming chamber
17 Nozzle exhaust, hose jet or nozzle section
18 Polymer stick saturated with chemicals
19 Cavity or canister
20 Static mixer (array of baffles or porous packing material)
21 Injection manifold
22 Pressure jet nozzle
23 Plunger-cylinder assembly
24 Compressed air source
25 Fully solidified polymer stick
26 Reloading door
27 Dissolution chamber outlet
31 Polymer stick canister
32 Partially solidified polymer stick
33 Extruder nozzle
34 Plunger-cylinder assembly
35 Compressed air source
36 Dissolution chamber outlet
41 Agitator or mixing blades
42 Compressed air source

DETAILED DESCRIPTION OF THE PREFERRED EMBODIMENTS

A preferred embodiment of an in-situ foam generation apparatus includes a dissolution chamber that houses one or more polymer sticks saturated with one or more cleaning agents that can be dissolved in water at different pressure settings and blown out as soft foam using compressed air, a mixing chamber arranged to receive the dissolved chemicals from the dissolution chamber, and a foaming chamber arranged to receive the mixed chemical-water mixture from the chamber and generate foam. The apparatus enables rapid and continuous generation of foam on-site and on-demand. Also, the apparatus can be easily tailored to utilize polymer sticks of different configurations (e.g., shape, size) based on the application. Moreover, polymer sticks of varying consistencies such as solidified and partially solidified can be used in this apparatus.

Referring to FIG. 1, a preferred embodiment of an in-situ foam apparatus 10 includes a dissolution chamber 13, a mixing chamber 14 connected to an outlet of the dissolution chamber 13, and a foaming chamber 16 connected to the outlet of the mixing chamber 14. The dissolution chamber 13 includes a cavity or canister 19 (see also e.g., FIG. 3 at canister 31) that houses one or more polymer sticks 18 of the same or different composition.

The polymer sticks 18 can be made of inorganic, environmentally safe, water-soluble chemicals mixed with surfactants, or their equivalent. The polymer stick 18 chemical configuration can be adjusted to specifically remove a particular type of dirt or residue, or a combination of residues from the equipment. In addition, the polymer stick 18 composition can be modified to obtain a varying end consistency like fully solidified or partially solidified states. The end consistency state should be such that it does not negatively affect the dissolution/foaming ability of the polymer sticks 18 or the cleaning efficacy of the loaded chemicals. Additionally, the shape of the polymer stick 18 can be any shape preferable, including but not limited cube, cuboid, parallellopied, or non-parallellopiped.

As the polymer sticks 18 are dissolved in the dissolution chamber 13 using an aqueous solution such as water, the cleaning agents are released from the sticks 18. The volume fraction of base polymer and the cleaning agents can be any fraction preferable for a particular application. In a preferred embodiment, the volume fraction is 80:20 base polymer to cleaning agent. In addition to the chemical composition, the rate of polymer stick 18 dissolution and foam generation is dependent on the inlet pressure and operating temperature, both of which can be adjusted for a particular application.

The dissolution chamber 13 is connected to an aqueous solution line through a flange connector 12. The aqueous solution line preferably delivers water to the chamber 13. The flow circuit contains an in-line water pressure regulator 11 which can be adjusted to vary the inlet water pressure, and will determine the rate and quality of foam generation.

Figure 2:
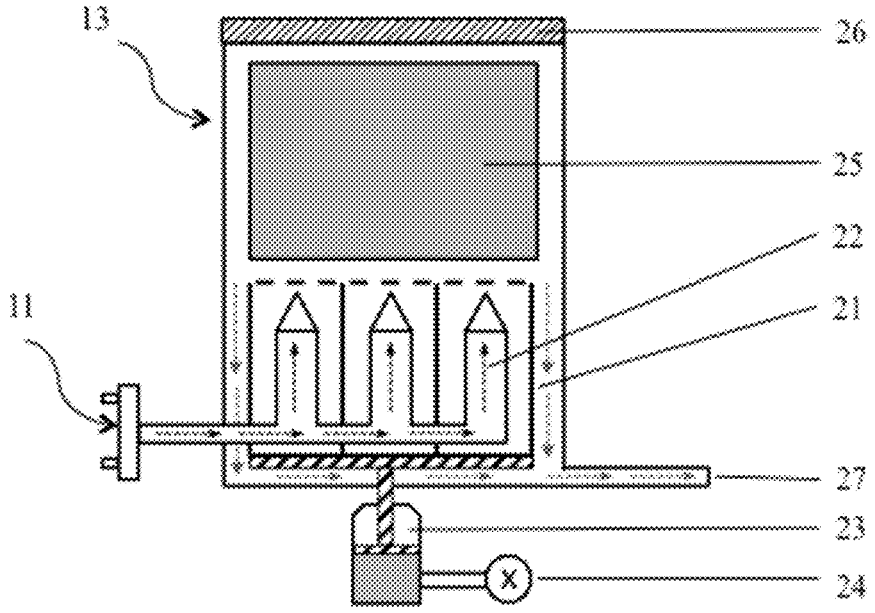
FIG. 2 is a sketch showing one configuration of the dissolution chamber used to dissolve polymer sticks with completely solidified consistency.

Referring to FIG. 2, the aqueous solution line is connected to an injection manifold 21 that is fabricated with an array of pressure jet nozzles 22 capable of delivering tightly grouped high-pressure water jets in a direction perpendicular to the water inlet. Preferably, manifold 21 is made out of corrosion resistant metal or plastic.

A fully solidified polymer stick 25 is arranged above the manifold 21 toward an upper end of the dissolution chamber 13 and is directly exposed to the high-pressure water jets of the injection manifold 21.

The polymer sticks 25 are loaded into the dissolution chamber 13 through the reloading door 26 at the upper end of the chamber 13. The distance between the injection manifold 21 and the polymer stick 25 can be adjusted by using a plunger-cylinder assembly 23 connected directly to the manifold 21, preferably operated by a compressed air source 24. Maintaining a constant distance between the manifold 21 and dissolving polymer stick 25 helps in uniform dissolution of the polymer stick 25 through the entire cycle. The uniformly dissolved polymer solution exits the dissolution chamber 13 at the dissolution chamber outlet 27.

Figure 3:
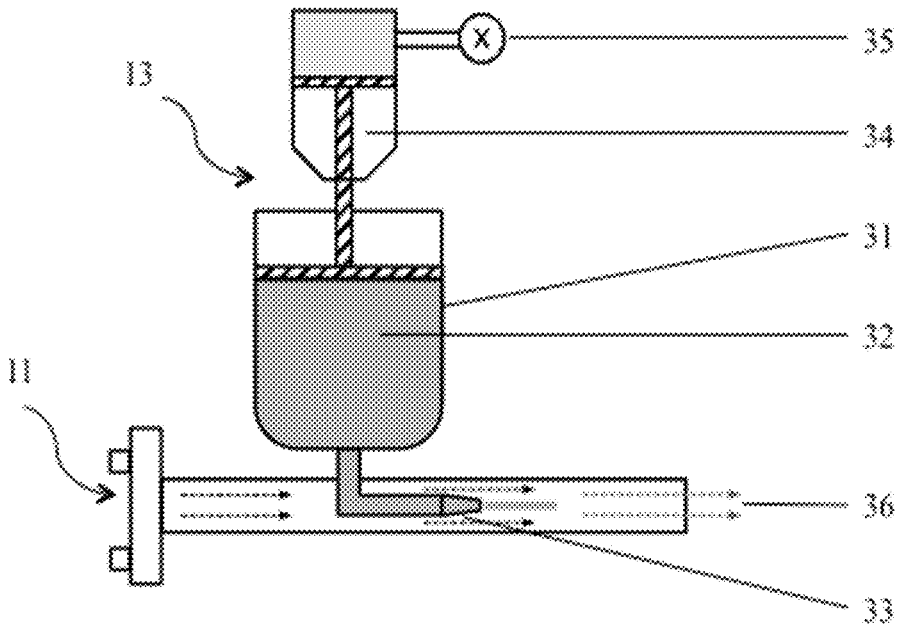
FIG. 3 is a sketch showing an alternative configuration of the dissolution chamber used to dissolve polymer sticks with partially solidified consistency.

Referring to FIG. 3, another preferred embodiment of the dissolution chamber 13 is particularly suitable for handling partially solidified polymer sticks 32. Semi-solid polymer sticks 32 act like a shear-thinning medium that can flow under a constant shear stress. The partially solidified polymer stick 32 is loaded into a canister 31 located at an upper end of the dissolution chamber 13 and arranged perpendicular to the pressure-regulated water line (indicated by pressure regulator 11). An extruder nozzle 33 located at a bottom end of the canister 31 is placed with its outlet facing the downstream direction of the water flow (to prevent water from seeping back into the canister 31). A constant shear stress can be applied to the polymer stick 32 inside the canister 31 through a plunger-cylinder assembly 34 located at an upper end of the canister 31 and preferably operated by a compressed air source 35. The polymer stick 32 starts to flow out of the extruder nozzle 33 and dissolve into the water stream. Water with dissolved chemicals exit the dissolution chamber outlet 36 to enter mixing chamber 14.

Referring to FIGS. 1 and 2, water with dissolved chemicals at the outlet 27 of dissolution chamber 13 is perfused through the mixing chamber 14. The mixing chamber 14 is preferably a static mixer 20 comprising an array of baffles engineered to uniformly mix the dissolved chemicals. Preferably, the baffles are made of corrosion resistant metal or plastic. Alternatively, the mixing chamber 14 is filled with a porous packing material such as, but not limited to, a metal mesh (preferably steel) or a non-reactive gravel mixture to facilitate uniform mixing of chemicals into water and act as static mixer 20. The major function of mixing chamber 14 is to disturb uniform flow lines of water and introduce turbulence in the flow to ensure uniform mixing of cleaning chemicals in water.

Figure 4:
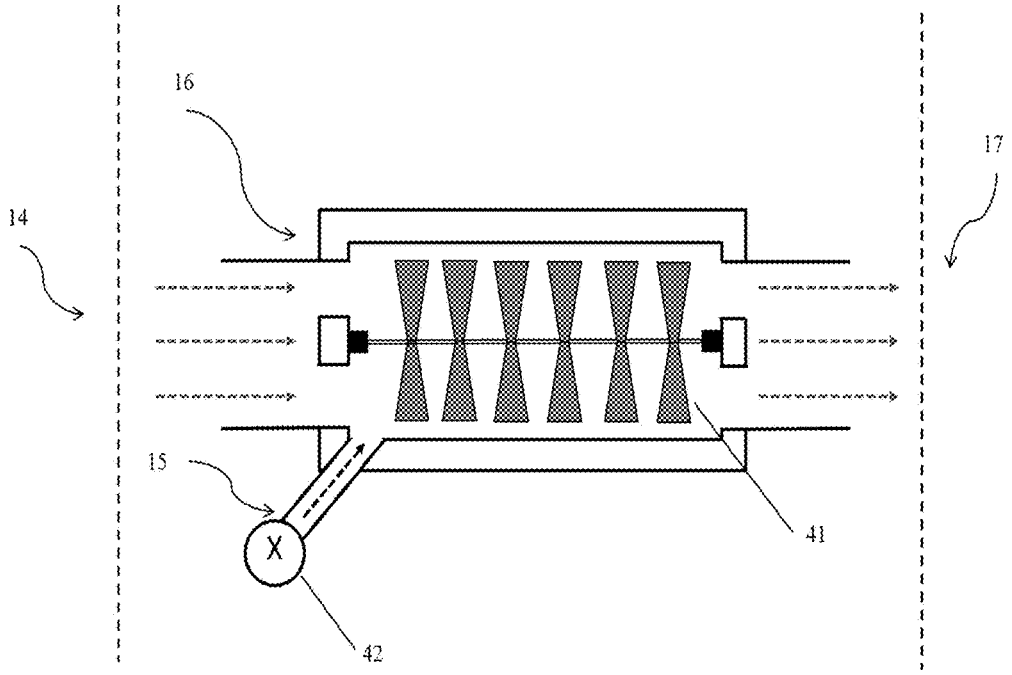
FIG. 4 is a sketch showing the foaming chamber used to generate soft foam by combining chemicals dissolved in water and compressed air.

Referring to FIGS. 1 and 4, the statically mixed chemical-water mixture exiting the mixing chamber 14 is then perfused through the foaming chamber 16, which is equipped with an agitator preferably in the form of a rotating mixer for final mixing and foam generation. Preferably, the rotating mixer is a series of turbine or mixing blades 41 suspended sequentially on a shaft in along the longitudinal centerline of the chamber 16. The mixing blades 41 are allowed to freely rotate about the center axis of the shaft. A pressure regulated compressed air source 42 is connected to the foaming chamber 16 and compressed air is delivered to the chamber 16 through compressed air line 15.

Pressurized foaming chemicals entering foaming chamber 16 along with the compressed air drives the shaft which, in turn, facilitates the foam generation. The compressed air pressure can be varied to control different foam characteristics such as but not limited to the chemical concentration per unit foam area, foam air bubble stiffness, and surface tension of foam bubbles. The foamed chemical mixture is then passed through a hose jet or convergent nozzle section 17 (see FIG. 1). The sudden increase in pressure near the convergent throat results in generation of high turbulent energy which agitates the chemical mixture, and high quality foam is discharged through the outlet of section 17.

The in situ foam generation apparatus 10, or at least one of its components, can be scaled up or down for specific applications. Some of the applications that could benefit from the deployment of the in situ foam generation apparatus 10 include but are not limited to (1) cleaning of fin and fan coolers in refineries, gas plants, gas transmission stations, chemical plants, geothermal power plants, and solar power plants; (2) cleaning of industrial radiators in natural gas compressors, engine driven air compressors, engine driven generators, and turbine oil coolers; (3) cleaning of air cooled compressors utilized in electric generation stations, and (4) cleaning of air conditioning evaporator coils.

While preferred embodiments of surfactants/chemicals in a polymer stick form factor and an apparatus for in-situ foam generation have been described, a person of ordinary skill in the art understands that certain changes may be made in the details of construction and the arrangement of components without departing from the spirit and scope of this disclosure or the following claims.

What is claimed is:

1. An apparatus for continuously delivering a surface activation (cleaning) agent on-demand as soft foam, the apparatus comprising:

a longitudinally extending wand including:

- a water inlet located at one end of the wand and configured for connection to continuous supply of pressurized water;
- a dissolution chamber in fluid communication with the water inlet, the dissolution chamber located toward the one end of the wand and housing a polymer stick canister;
- a mixing chamber in fluid communication with an outlet of the dissolution chamber and housing a static mixer located coaxial to a longitudinal centerline of the wand;
- a foaming chamber in fluid communication with an outlet of the mixing chamber, the foaming chamber including a compressed air inlet configured for connection to a continuous source of pressurized air and housing a mechanical agitator located coaxial to a longitudinal centerline of the wand and in fluid communication with the compressed air inlet, the mechanical agitator and including a plurality of rotating blades configured for rotation about the longitudinal centerline;

a nozzle exhaust located at another end of the wand and in fluid communication with an outlet of the foaming chamber.

2. An apparatus according to claim 1 further comprising one or more polymer sticks containing one or more cleaning agents.

3. An apparatus according to claim 1 wherein an end consistency of at least one of the one or more polymer sticks is in a range of partially solidified to fully solidified.

4. An apparatus according to claim 1 further comprising the dissolution chamber having:

an injection manifold connected to the dissolution chamber inlet, the injection manifold having an array of jet nozzles oriented toward the polymer stick canister;

a plunger-cylinder assembly arranged to move the injection manifold relative to the polymer stick canister; and a compressed air source in fluid communication with the plunger-cylinder assembly.

5. An apparatus according to claim 4 wherein the injection manifold is maintained at a constant distance from the polymer stick canister.

6. An apparatus according to claim 4 further comprising a pressure regulator arranged to control a line pressure to the dissolution chamber inlet.

7. An apparatus according to claim 1 further comprising the dissolution chamber including:

a plunger-cylinder assembly to apply shear stress to contents of the polymer stick canister; and a compressed air inlet in fluid communication with the plunger-cylinder assembly.

8. An apparatus according to claim 7 further comprising a pressure regulator arranged to control a line pressure to the dissolution chamber.

9. An apparatus according to claim 7 further comprising an extruder nozzle connected to a bottom of the polymer stick canister.

10. An apparatus according to claim 9 wherein an outlet of the extruder nozzle being arranged to face in a downstream direction.

11. An apparatus according to claim 1 wherein the static mixer of the mixing chamber is a porous packing material.

12. An apparatus according to claim 11 wherein the porous packing material is a metal mesh.

13. An apparatus according to claim 11 wherein the porous packing material is a non-reactive gravel mixture.

14. An apparatus according to claim 11 wherein the static mixer is an array of fixed baffles.

15. An apparatus according to claim 1 wherein a speed of the mechanical agitator is controlled by an inlet pressure of a foaming chemical and the compressed air entering the foaming chamber.

16. An apparatus according to claim 1 wherein pressure of the compressed air entering the foaming chamber is controlled to maintain quality of foam produced at the foaming chamber outlet.

* * * * *